United States Patent [19]

Jahsman et al.

[11] 4,449,262

[45] May 22, 1984

[54] MEDICAL COUCH INCORPORATING A LIFTING MECHANISM

[75] Inventors: Hendrick Jahsman, Berkeley; George Menor, Martinez, both of Calif.

[73] Assignee: Siemens Medical Laboratories, Inc., Walnut Creek, Calif.

[21] Appl. No.: 299,881

[22] Filed: Sep. 8, 1981

[51] Int. Cl.[3] ..... A61G 7/00

[52] U.S. Cl. ..... 5/63; 5/11; 248/421

[58] Field of Search ..... 5/60, 63–65, 5/62, 11; 248/421, 544, 588, 651

[56] References Cited

U.S. PATENT DOCUMENTS

| | | | |
|---|---|---|---|
| 346,246 | 8/1886 | Uhde . | |
| 2,547,827 | 4/1951 | Logan . | |
| 3,179,722 | 3/1965 | Alm | 5/63 |
| 3,202,566 | 11/1966 | Clarke | 5/63 |
| 3,203,670 | 8/1965 | Farris | 5/62 |
| 3,308,485 | 3/1967 | Nesbit-Evans | 5/63 |
| 3,373,453 | 3/1968 | Goodman | 5/63 |
| 3,465,373 | 9/1969 | Wilson | 5/63 |
| 3,611,452 | 10/1971 | Turko et al. . | |
| 3,686,696 | 8/1972 | Lanigan . | |
| 3,733,623 | 5/1973 | Croxton | 5/63 |
| 3,743,344 | 7/1973 | Jameson | 5/63 |
| 3,793,652 | 2/1974 | Linehan . | |
| 3,802,002 | 4/1974 | Jonas | 5/63 |
| 3,991,428 | 11/1976 | Hanson | 5/63 |
| 4,071,222 | 1/1978 | Wright | 5/2 |
| 4,173,372 | 11/1979 | Norris | 248/421 |

FOREIGN PATENT DOCUMENTS

| | | | |
|---|---|---|---|
| 1447701 | 9/1965 | France . | |
| 1319593 | 6/1973 | United Kingdom | 5/63 |
| 1468255 | of 1977 | United Kingdom | 5/63 |

*Primary Examiner*—Alexander Grosz
*Assistant Examiner*—Michael F. Trettel
*Attorney, Agent, or Firm*—Karl F. Milde, Jr.; Max Moskowitz

[57] ABSTRACT

The medical couch contains a lower frame, an upper frame for carrying a patient table top, and a link mechanism interconnecting both frames. The link mechanism includes two pairs of pivotally interconnected support arms which are operated in a scissors action to lift and lower the upper frame with respect to the lower frame. An electronic motor drive system containing an electric motor and a lead screw is provided for performing such operation. The drive system is pivotally connected to the lower frame such that the lead screw extends towards the upper frame. The drive system is rotatable about a pivoting axis which is arranged horizontally. A nut element which is mounted on the lead screw travels therealong when the motor is in operation. The nut element is provided for supporting the link mechanism. It is pivotally connected therewith. The nut element will pivot about an upper horizontal axis when it travels along the lead screw. The nut element moves the upper frame to a selected horizontal position above and parallel to the lower frame. A spring device is provided for preventing a sudden return of the couch from a raised position to a lowered position. The spring device preferably contains a multitude of spring washers which are slidably arranged on a guiding shaft.

6 Claims, 9 Drawing Figures

MEDICAL COUCH INCORPORATING A LIFTING MECHANISM

CROSS REFERENCE TO RELATED APPLICATION

This application relates to the same technical field as the commonly owned application of Lothar Heinz, George Menor and Hendrick Jahsman, entitled "Medical Couch", Ser. No. 299,882, filed on the same day as this application.

BACKGROUND OF THE INVENTION

1. Field of the Invention

This invention relates to a novel and improved medical couch. Particularly, this invention relates to a treatment couch which can be used for treating patients in radiotherapy. Still more particularly, this invention relates to a treatment couch for treating patients with X-rays and/or electrons.

2. Description of the Prior Art

Medical couches and hospital beds that incorporate mechanisms for lifting a patient are well-known in the art.

U.S. Pat. No 346,246 discloses a medical operating couch having a lower frame and an adjustable upper frame. By turning two threaded rods, the couch top can be raised and lowered horizontally, or it can be adjusted on an incline. Difficulties must by expected when the couch is raised from a low position since this requires considerable force, and the threaded rods and heads must be dimensioned accordingly.

U.S. Pat. No 2,547,827 discloses a hospital bed which is vertically adjustable and universally tiltable. In this hospital bed, a motor is used to rotate a horizontally disposed shaft. Also in this design, difficulties in lifting the bed may be expected when the bed is in its lowered position. The lifting range is limited, and the lifting mechanism requires some space.

French Pat. No. 1,447,701 discloses a hospital bed the top of which is also adjustable vertically; that is the top will stay in a horizontal position during and after the adjustment. This lifting mechanism requires a special motor since it is essential that the lead screw moves through the motor. Therefore, a certain depth is needed below the motor. Such requirement is adverse to a compact design of the lifting mechanism. Also, provisions must be made that the lead screw is not positioned vertically, otherwise it would not be possible to lift the couch.

U.S. Pat. No. 3,373,453 discloses a vertically adjustable bed which contains a lower and an upper frame. In this design, the lifting mechanism including the lower assembly is rather complex, and a large number of parts are required. The cross bars of the lifting mechanism are interconnected by a coil spring. If the coil spring should break, the bed may collapse very quickly. A simple coil spring, therefore, does not provide optimum security.

Other known structures such as shown in U.S. Pat. Nos. 3,611,452, 3,686,696 and 3,793,652 require an unduly and commercially undesirable large number of parts and of space in and beneath the bed to accomodate the lifting mechanism.

SUMMARY OF THE INVENTION

1. Objects

It is an object of this invention to provide a medical couch which is vertically adjustable to small increments of height and which is nevertheless sturdily and rigidly supported in all positions.

It is another object of this invention to provide a vertically adjustable medical couch which is simple in construction, inexpensive to manufacture and easy to operate.

It is still another object of this invention to provide a vertically adjustable medical couch in which the mechanism for the vertical adjustment is of a compact structure.

It is still another object of this invention to provide a vertically adjustable medical couch which can be transformed from a lowered position to a raised position, and vice-versa, without medically undesirable vibrations.

It is still another object of this invention to provide a medical couch which avoids transmission cables between a motor drive and the couch components to be raised or lowered.

It is still another object of this invention to provide a medical couch having high stability.

It is still another object of this invention to provide a vertically adjustable couch which is no hazard to a patient lying on the couch when a malfunction of its vertical drive system occurs.

It is still another object of this invention to provide a vertically adjustable medical couch in which an operator (e.g. surgeon, nurse) has free access from all sides without meeting difficulties with regard to jutting-out components and parts.

It is still another object of this invention to provide a medical couch which can be lifted from a lowered position to a raised position without any starting difficulties.

2. Summary

According to the invention, a medical couch is provided which has a lower frame arranged in a first horizontal plane. An upper frame for carrying a patient table top is arranged in a second horizontal plane above the first horizontal plane. A scissors action link mechanism interconnects the lower frame with the upper frame. This scissors action link mechanism is determined for moving the upper frame parallel to the lower frame from a lowered to a raised position, and vice-versa. The scissors link mechanism includes a single first and a second pair of pivotally interconnected support arms or scissors. The first pair of support arms is arranged in a vertical plane between one side of the lower frame and one side of the upper frame, and the second pair of support arms is arranged in a vertical plane between the opposite side of the lower frame and the opposite side of the upper frame. Thereby, both pairs of pivotal support arms are arranged parallel with respect to each other. Thus, a single scissors arrangement (as opposed to a double or multi-scissors arrangement) is obtained.

The lifting mechanism of the medical couch comprises an electric motor drive system which contains an electric motor and a threaded lead or rod. The lead rod is rotatable by the motor. It is longitudinally fixed with respect to the drive system. In other words, the lead rod cannot travel in its longitudinal direction, e.g. through the motor.

There is also provided a lower pivoting device for pivotally connecting the drive system to the lower frame and for pivoting the drive system about a stationary horizontal axis. The lead rod extends towards the upper frame. During operation it pivots in a plane which is inbetween and parallel to the two pairs of support arms.

A nut element is arranged between the first and the second pairs of support arms. The nut element is mounted on the lead rod in order to travel therealong.

An upper pivoting and supporting device is connected to the nut element for pivoting the nut element about an upper horizontal axis and for supporting the scissors link mechanism. The upper horizontal axis is arranged elevated above the lower horizontal axis. In operation of the lifting mechanism, the upper horizontal axis is moved parallel to the lower horizontal axis. Thereby, the upper pivoting and supporting device selectively adjusts the elevation of the scissors link mechanism above the lower frame when the motor is in operation and the nut element travels along the threaded rod, thereby moving the upper frame into a selected position.

There is also provided a security device for preventing a sudden return from a raised position to a lowered position. This security device may preferably contain spring elements(s) such as a large number of spring washers slidably arranged on a guiding shaft.

The foregoing and other objects, features and advantages of the invention will be apparent from the following more particular description of preferred embodiments of the invention, as illustrated in the accompanying drawings.

DETAILED DESCRIPTION OF THE PREFERRED EMBODIMENTS

Figure 1:
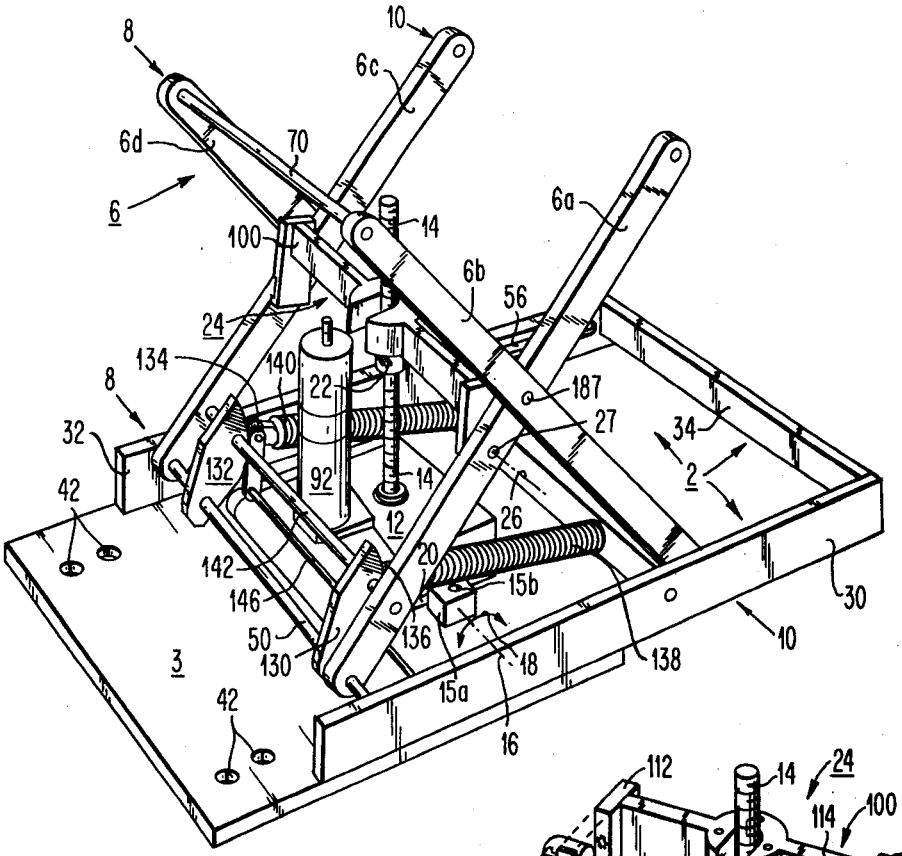
FIG. 1 is a perspective view of the lower portion of a medical couch according to the invention, the couch being in a raised position.
Figure 4:
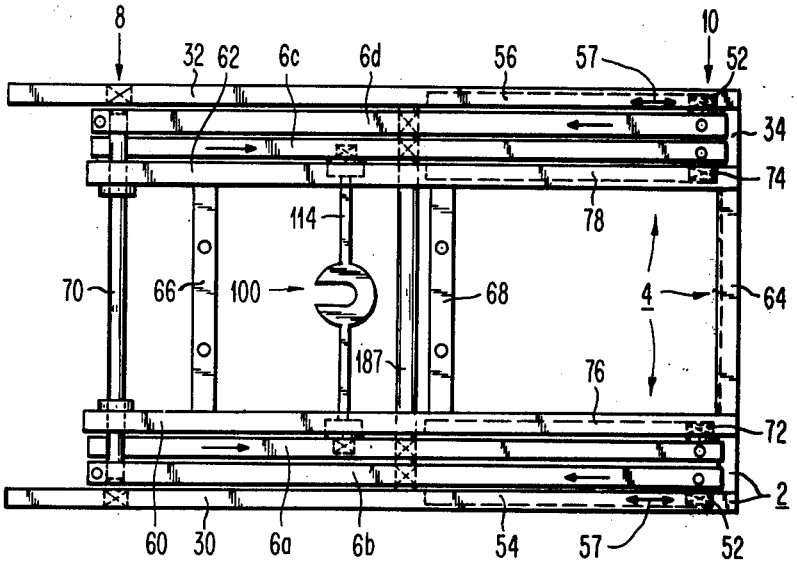
FIG. 4 is a top or plan view of the lower part of the medical couch of FIG. 1.

With reference to FIG. 1, the lower portion of a medical couch is schematically illustrated in its raised or elevated position. FIG. 4 affords a plane view of the medical couch when it is in its lowered position. Only the most important parts are schematically shown in Figs. 1 and 4 in order to depict clearly the operation of the lifting mechanism of the couch.

The couch is of the type having a single scissors arrangement. It may primarily be used in radiation therapy for irradiation of a patient by electrons and/or X-rays, in particular in conjunction with a linear accelerator.

A lower frame or support rail assembly which is generally designated as 2 is arranged in a lower horizontal plane. The configuration of the frame 2 is essentially rectangular. The frame 2 which is U-shaped is firmly connected to a rectangular base plate 3. The plate 3 may be made out of steel, for instance. Operatively connected to the lower frame 2 is an upper frame which is generally designated as 4, see FIG. 4. The configuration of this upper frame 4 is also essentially rectangular. The upper frame 4 is smaller in width than the lower frame 2. It is located directly above the lower frame 2. Thus, the frame 4 is arranged in an upper horizontal plane above and parallel to the lower plane. The upper frame 4 is determined for carrying a table top or mattress frame on which a patient may rest for treatment, see Fig. 9. The upper frame 4 supports a rotation ring 5 (see FIG. 9). This ring 5 may carry a device for performing longitudinal motions. This device in turn may carry the table top proper. The outer part of the rotation ring 5 can be rotated about a vertical axis. Therefore, the ring 5 may be termed treatment table top rotation.

In FIGS. 1 and 4 is illustrated that a scissors action link mechanism interconnects the lower frame 2 and the upper frame 4. The scissors link mechanism is generally designated by reference numeral 6. This mechanism 6 serves to move the upper frame 4 parallel to the lower frame 2 from a lowest horizontal position to a highest horizontal position, and vice versa. All intermediate positions can be taken. As will be explained in more detail later, the link mechanism 6 includes a first and a second pair of pivotably interconnected support arms or lift bars **6*a*, 6*b* and 6*c*, 6*d*, respectively. The first and second pairs are positioned vertically and connected to opposite sides of the frames 2 and 4. Each pair consists of two acting links or arms 6*a*, 6*b* and 6*c*, 6*d***, respectively. In other words, the link mechanism includes two sets of two interconnecting links or arms.

The single link mechanism has a lower and an upper fixed left end portion 8 which are pivotly connected to the frame 2 and 4, respectively, and a lower and an upper right end portion 10 which are pivotly and slidably connected to the frames 2 and 4, respectively, as will become apparent later. The term "fixed" used herein refers to translations, not to rotations.

The medical couch further contains an electric motor drive system 12. This drive system 12 preferably includes an electric motor and a gear system (see FIG. 3). The drive system 12 rotates a threaded lead rod or lead screw 14 which is fixed in its longitudinal direction. The lead screw 14 extends upwardly from the drive system 12 in an oblique direction. It is arranged in a plane approximately halfway between the two vertical arm scissors **6*a*, 6*b* and 6*c*, 6*d***.

Figure 3:
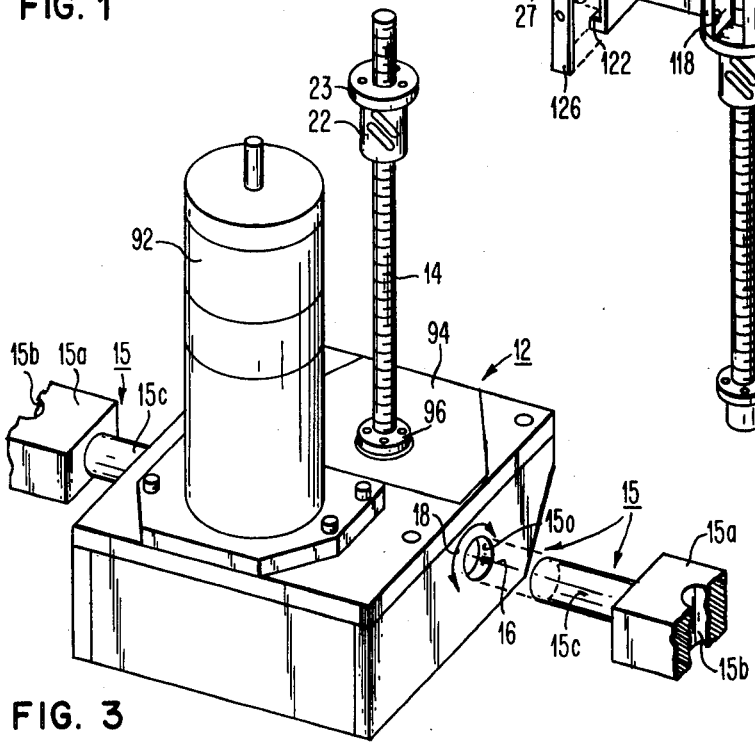
FIG. 3 is a perspective view of the electric motor drive system and its pivoting device used in the medical couch of FIG. 1.

The drive system 12 is supported by and pivotly connected to the base plate 3 by means of a pivoting device 15, as shown in FIGS. 1 and 3. The pivoting device 15 comprises two pivot mounts or blocks each provided on one of opposite sides of the drive system 12. Only the right mount **15*a* can be seen in FIG. 1. The pivot mounts 15*a* are firmly connected to the base plate 3, for instance by bolts (not shown) projecting through vertical openings 15*b*. Each contains a round end piece, that is a bolt or pivot 15*c* which projects into a respective opening or circular holes 15*o* (see FIG. 3) in the housing of the drive system 12. In FIG. 3 the mounts 15*a* are shown removed from the motor drive system 12. Due to the pivoting device 15, the drive system 12 may be pivoted about a lower horizontal axis 16 which is stationary. This is indicated in FIGS. 1 and 3 by a double arrow 18. The horizontal axis 16 is positioned perpendicularly to the longitudinal axis of the lower frame 2**.

The motor system 12 does not occupy and thus leaves free the space below the lower surface of the base plate 3 even when the motor system 12 is rotated about the stationary horizontal axis 16 from one side to the other. To this end, the middle section of the base plate 3 is provided with a cut-out 20. Therefore, the base plate 3 can be positioned directly on the floor of a hospital. It can also be mounted on low casters close to the floor. The cut-out allows the lifting assembly to swivel freely.

A nut element 22, particularly a ball nut, is mounted on the lead screw 14 for travelling therealong. That is, the thread of the nut element 22 is complementary to that of the lead screw 14. The lead screw 14 and the nut element 22 are arranged in the space between the two scissors 6*a*, 6*b* and 6*c*, 6*d*. The nut element 22 is provided with a cylindrical upper end piece 23 which serves for fastening a cross-bar, as will be explained below.

Of importance to a flawless lifting operation of the medical couch is an upper pivoting and supporting device or lift assembly 24. This device 24 is pivotly connected to and combined with the nut element 22. It supports and moves the scissors link mechanism 6. It will be noted that the link mechanism 6 is supported at its lower fixed end portion 8 by the lower frame 2, at its lower slidable end portion 10 also by the lower frame 2, and additionally at the lower portions of the arms 6*a* and 6*c* by the lift assembly 24.

Figure 2:
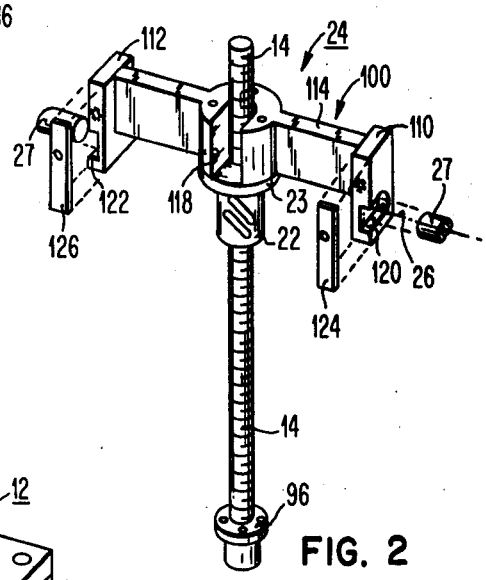
FIG. 2 is a perspective view of the upper pivoting and supporting device of the medical couch illustrated in FIG. 1.

As can be seen in FIGS. 1 and 2, the pivoting and supporting device 24 is pivotly connected to the link mechanism in an upper horizontal axis 26 which is located above and parallel to the lower horizontal axis 16. In operation, the upper horizontal axis 26 is moved parallel to the stationary lower axis 16 and therefore parallel to the plane of the lower frame 2. It must be emphasized that the upper horizontal axis 26 is a movable swivel axis, whereas the lower horizontal axis 16 is a stationary axis. In particular, the upper axis 26 is arranged such that it is closer to the fixed end portion 8 than to the sliding portion 10 when the couch is in its lifted position (FIG. 1).

The upper horizontal axis 26 may be formed by two aligned horizontal pins 27 which are firmly housed in holes located in the scissors arms 6*a* and 6*c*, respectively. As illustrated, these holes are located below the crossing points of the scissors. The crossing points of the scissors are located preferably at approximately 0.5 the total length of the crossing arms. The horizontal pins 27 that form the swivel axis 27 project into the interior of the scissors mechanism 6.

When the motor system 12 is in operation in order to lift the medical couch, the lead screw 12 is rotated such that the ball nut 22 travels axially along the lead screw 14 from a lower position to a higher position. The drive force is transmitted to the link mechanism 6 through the pivoting and supporting device 24 including the nut element 22. This causes the arms 6*a* and 6*c* to rotate about their lower ends. It also causes the lower ends of the arms 6*b* and 6*d* to travel horizontally along grooves in the in the frame 2 from right to left. Thereby, the crossing angle between the crossing arms of each pair of scissors is varied. The ball nut 22 follows the horizontal motion of the upper horizontal axis 26 by pivoting about the lower horizontal axis 16 with the lead screw 14 and the drive system 12. The upper frame 6 is moved thereby into a selected position. It will be noted that the lead screw 14 will be pivoted through its vertical position when the couch is raised from its completely collapsed position to its highest position.

In FIGS. 1 and 4 details of the lower rectangular frame 2 are illustrated. The lower frame 2 essentially consists of two longitudinal side walls 30 and 32 and a transverse side wall 34. The side walls 30, 32 and 34 may preferably consist of solid steel. They are all of rectangular cross section. The side walls 30–34 and the base plate 3 (not shown in FIG. 4) are welded or bolted together to form a rigid assembly of essentially rectangular shape. The end portion of the base plate 3 is provided with holes 42 for securing the lower frame 2 to the floor or to a platform (not shown).

A first shaft or bar 50 horizontally projects through the lower ends of the arms 6*a*, 6*c*. The bar 50 is secured with its ends in the side walls 30, 32. The bar 50 is a transverse bar. It is used as a pivoting axis and represents the lower part of the fixed end portion 8 of the link mechanism 6. The lower part of the sliding end portion 10 is represented by smaller second transverse bars or rods 52 which are arranged in line with each other and parallel to the first transverse bar 50. The second bars 52 are also used as pivoting axes. The outer ends of the second transverse bars 52 slide in channels or grooves 54 and 56, respectively. These grooves 54 and 56 are arranged horizontally in the inner surfaces of the right side of the longitudinal walls 30 and 32, respectively. The two outer ends of the bars 52 may be provided with rollers (not shown) for an easy travel in the inner grooves 54 and 56. The horizontal sliding motion is indicated in FIG. 4 by double arrows 57. The inner ends of the second bars 54 and 56 are secured in the ends of the arms 6*b* and 6*d*, respectively.

Figure 9:
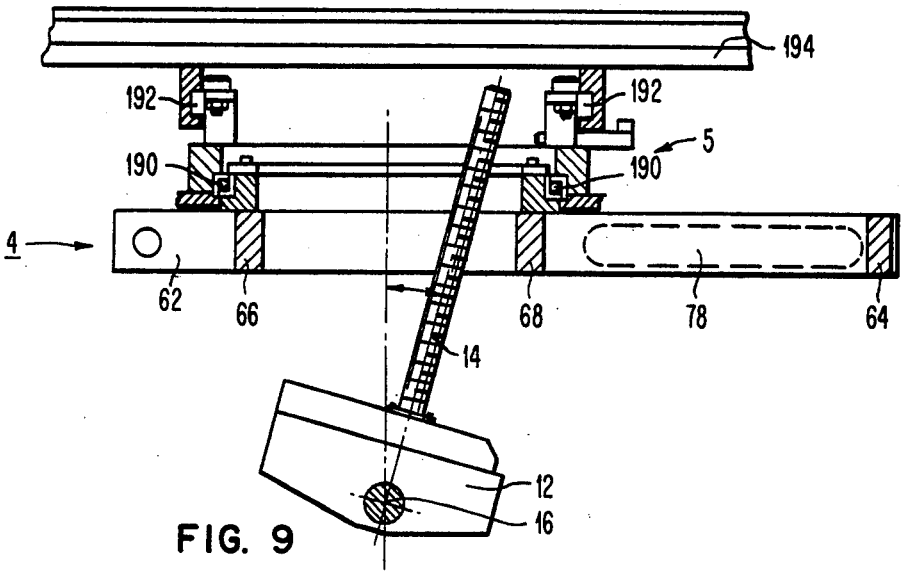
FIG. 9 is a cross-sectional view of the medical couch mechanism of FIG. 1 provided with a rotatable table top.

Details of the upper frame 4 are illustrated in FIGS. 4 and 9. The upper frame 4 is smaller than the lower frame 2. It contains two longitudinal side walls 60 and 62, which are positioned parallel to each other, and three transverse cross bars or side walls 64, 66 and 68, which are also positioned parallel to each other. All side walls 60–68 are made of solid steel. Preferably, they have a rectangular cross section. They are welded or bolted together such as to form a rectangular wall assembly. Whereas the side wall 64 is connected to the right ends of the longitudinal side walls 60 and 62, the side walls 66 and 68 interconnect the longitudinal side walls 60 and 62 at their left end section and their middle section, respectively.

A third transverse shaft or bar 70 projects through the left ends of the side walls 60 and 62. This third bar 70 is a pivoting axis. It represents the upper part of the fixed end portion 8 of the link mechanism 6.

The upper part of the sliding end portion 10 is represented by two fourth transverse pins or bars 72 and 74 which are axially aligned and which are arranged parallel to the third bar 70. The outer ends of these bars 72 and 74 are secured in the upper end portions of the arms 6*a* and 6*c*, respectively. In FIG. 1, solely the holes for carrying the upper frame 4 can be seen. The ends of these smaller fourth bars 72 and 74 facing each other slide in channels or grooves 76 and 78, respectively. The grooves 76 and 78 are arranged horizontally in the outer surfaces of the longitudinal walls 60 and 62, respectively, on their right side. The inner ends of the pins or bars 72 and 74 may be provided with rollers (not shown) for an easy ride in the outer grooves 76 and 78, respectively.

As can be seen in FIGS. 1 and 4, the scissors link mechanism 6 includes the four bars, links or arms *6a, 6b, 6c* and *6d* in double link arrangement. The double link arrangement is positioned vertically on the lower frame 2. The links *6a* and *6c* are the outer links of the two pairs of pivotal arms. The links *6a, 6b, 6c, 6d* all have the same length. In FIG. 4, arrows indicate in which direction the individual links *6a–6d* are elevated.

The links of the double link arrangement are secured and pivotly connected to each other by a connection member, rod or bar 187. The transverse connection bar 87 connects both with each other. It is parallel to the side wall 34 of the lower frame 2.

In FIGS. 1 and 3, details of the electric motor drive system 12 are illustrated. This drive system 12 contains an electric motor 92 and a gear system 94 operatively connected to the motor 92. The lead screw 14 extends upwardly from the box or housing of the gear system 94. The lead screw 14 is longitudinally fixed to the box of the gear system 94 by a ring 96 which is secured thereto by screws. It should be pointed out that also two lead screws or a multiple screw system having three or more lead screws may be applied.

In operation, the drive system 12 pivots about the lower horizontal axis 16, as indicated above. For this purpose, the above-mentioned lower pivoting device 15 is provided. This device 15 is made up of the two horizontal pins 15*c* which extend from the blocks 15*a* located at two opposite sides of the electric motor drive system 12. The pins 15*c* have outer ends which fit into the holes 15*o* provided in the middle section of the side walls of the gear system 94. Thus, the lead screw 14 may be tilted about the lower horizontal axis 16.

As can be seen in FIG. 2, the ball nut 22 is threadedly received on the lead screw 14. When the lead screw 14 is rotated, the ball nut 22 travels along the longitudinal axis. The ball nut 22 consists of a cylindrical lower part of smaller diameter and a cylindrical upper part 23 of greater diameter. The upper part contains four holes, three of which can be seen in FIG. 3, for securing the ball nut 22 to the upper pivoting and supporting device 24 of FIG. 2.

An embodiment of the upper pivoting and supporting device 24 is shown in FIG. 2. This device 24 is essentially formed by an elongated element or cross bar 100. The cross bar 100 contains two parallel side pieces, side arms or side stand-offs 110 and 112 and a bar 114. The bar 114 connects the stand-offs 110 and 112 with each other. The bar 114 may be welded to the stand-offs 110 and 112. The cylindrical upper part of the ball nut 22 is connected from below to the widened middle section of the transverse bar 114. For this purpose, the four aforementioned holes in the cylindrical upper part 23 (see FIG. 3) are provided. The widened middle section of the bar 114 contains a central recess or free space 118. The lead screw 14 extends into and through the free space 118. Since the recess 118 is open on one side, it is very easily possible to take out the lift assembly including the motor, the gear system and the brake system to be described.

As mentioned earlier, the device 24 may be pivoted about the upper horizontal axis 26. For this purpose the two horizontal pivots 27 are provided. They are axially aligned. The outer ends of the pivots 27 are received by recesses or slots 120 and 122, respectively, provided in the outer surfaces of the stand-offs 110 and 112. The slots 120 and 122 may be closed from one side by securing plates 124 and 126, respectively. These plates 124, 126 can easily be attached and removed, for instance by screws.

As can be seen in FIG. 1, two bores or holes are provided in the inner links *6a* and *6c*, respectively, for securing the pivots 27. These holes are located below the holes containing the transverse lower bar 187. Thus, the bar 114 may rotate about the axis 26 by means of the pins 27 introduced into the recesses 120 and 122.

As illustrated in FIG. 3, the device 24 supports the link mechanism 6 in the axis 26 which is located a little distance below the axis of the transverse bar 187. However, it is also possible to use the axis of the transverse crossing bar 187 as the upper movable axis 26. In such a design, the cross bar/pivot combination of FIG. 2 would pivotly interconnect the crossing points of the two scissors *6a, 6b* and *6c, 6d*.

When the motor 92 is energized and the ball nut 22 travels along the lead screw 14, the cross bar 100 will either lift or lower the link assembly 6, depending on the direction of rotation. Thereby, the combination of the drive system 12 and the lead screw 14 will be pivoted about the lower horizontal axis 16. As can be seen in FIG. 1, the lower pivoting axis 16 is arranged parallel to the longitudinal axis of the connecting bar 87. When the couch is raised or lowered, the lead screw 14 will be moved in a plane which is located between the double link arrangement.

Figure 5:
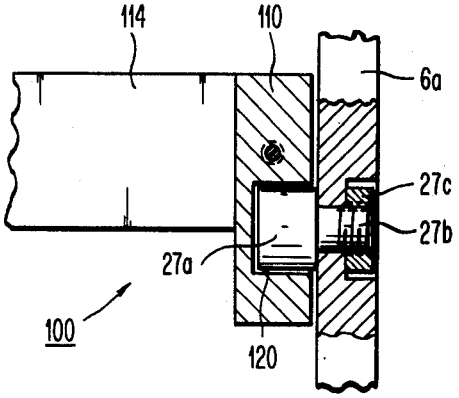
FIG. 5 is a cross section of a portion of the pivoting device of FIG. 2.

In FIG. 5 another embodiment of the cross bar 100 is illustrated. A rectangular bar 114 is welded to a rectangular side piece 110. The side piece 110 contains a recess 120 which is part of a pivoting device. This pivoting device allows for relative rotations between the cross bar 100 and the lift bar *6a*. Note that there is a small space inbetween to allow for such relative movements. The pivoting device also contains a camroll bearing 27*a* having a stud 27*b* with a thread thereon. The stud 27*a* is introduced in an opening contained in the bar *6a*. A nut 27*c* is placed on the thread of the stud 27*b*, thereby securing the camroll 27*a* to the lift bar *6a*.

FIG. 1 illustrates that a spring security device is provided for preventing a sudden return of the couch from a raised position to its collapsed position. The security system is based on the idea to store energy in springs when the couch is brought into a lower position. Details of the security system are illustrated in FIGS. 1, 6, 7 and 8. This system makes sure that the couch is no hazard to a patient in the case that the electrical power supplying the motor 92 fails, or that an individual spring breaks.

As can be seen in FIG. 1, the security system essentially contains two parallel cams 130 and 132, two parallel cam followers 134 and 136, and two spring systems 138 and 140, which are also arranged parallel to each other. Both spring systems 138, 140 work parallel to each other. They are actuated by the cam followers 134 and 136, respectively, which in turn are actuated by the cams 130 and 132, respectively. Therefore, two identical partial systems are applied. Both cams 130 and 132 are commonly activated by the link mechanism 6.

Figure 6:
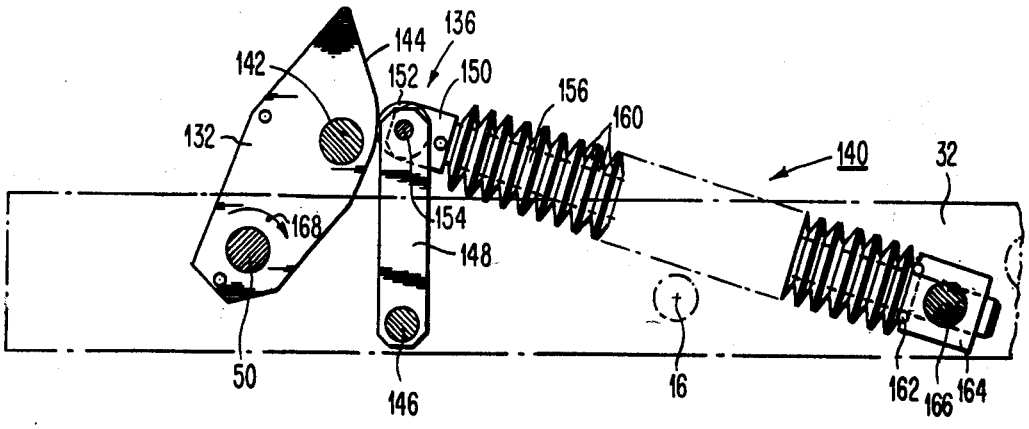
FIG. 6 is a side view of the spring security system used in the medical couch of FIG. 1.

As illustrated in FIG. 6, the cam 132 of the rear partial system has the shape of an elongated disc. It is kept in a vertical position between the double link mechanism arrangements by means of the bar 50 and an additional transverse bar 142 connecting the links *6a* and *6c* above the bar 50. Thus, the cam 132 may rotate along with the links *6a* and *6c* about the axis of the bar 50. The cam 132 is positioned close to the link *6c*. Similarly, the cam 130 which is also supported by the bars 50 and 142, is positioned close to the link *6a*.

The cam 132 has a concave cam surface 144 which is directed to the interior of the link arrangement 6. The same applies to the cam surface of the cam 130.

As shown in FIG. 1, both cams 130 and 132 are pivotly arranged on the bar 50 on opposite sides thereof. They are guided by the additional bar 142. When the links *6a* and *6c* are rotated about the axis of the bar 50, the cams 130 and 132 are simultaneously rotated about this axis. The cam followers 134 and 136 will firmly engage the cam surfaces of the cams 130 and 132 and follow their shape. The cam followers 134 and 136 are pivotly mounted on a small transverse shaft 146. The shaft 146 connects the frame 30 with the frame 32. It is arranged parallel to the bar 50.

As shown in FIG. 6, the cam follower 136 comprises an arm or lever 148 which is rotatable about the shaft 146, a cam holder or roller yoke 150, and a roller 152 contained therein by means of a pin 154. The cam holder 150 is secured on the first end of a gliding shaft or guiding rod 156 which is part of the spring system 140.

Figure 7:
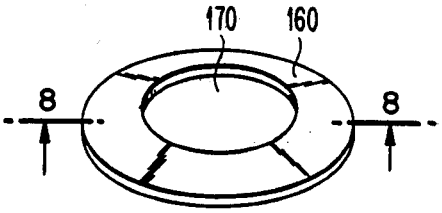
FIG. 7 is a perspective view of a spring washer used in the spring security system of FIG. 6.
Figure 8:
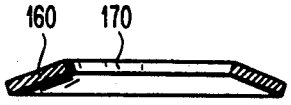
FIG. 8 is a cross-sectional view of the spring washer of FIG. 7.

The spring system 140 contains a great number of individual saucer-shaped springs or spring washers 160 (see FIGS. 7 and 8). These spring washers 160 are faced cup to cup to form an elongated spring. This spring is determined to provide a balancing force. The spring washers 160 may preferably be Bellevelle spring washers. The illustrated spring system containing a series of individual spring washers has the advantage that it can store much force in a small space. The individual spring washers 160 are slidably arranged on the guiding rod 156.

On the second end of the guiding rod 156 is arranged a sliding ring 162. This sliding ring 162 is attached to a head 164 which has the form of a cube. The head 164 is rotatably mounted on a horizontal shaft 166 which extends from side wall 30 to side wall 32 close to the pins 52 and 54. The cube head 164 has a bore or hole therethrough, thereby forming a container. The bore extends parallel to the link arrangement. The guiding rod 156 is mounted such that it slidably passes through the head 164, as can be seen in FIG. 6.

When the couch is lowered, for instance by energizing the motor 92, the spring system 140 will be compressed. This is performed in the following way: the cam 132 will rotate clockwise about the axis 50 as indicated by the arrow 168 (FIG. 6). The roller 152 of the cam follower 136 follows the cam surface 144 which will be pressed firmly thereto. Thereby it is pushed to the right side in FIG. 6. The cam holder 150 will exercise some pressure on the spring washers 160 which cannot retreat to the right side. They are longitudinally fixed by the ring 162 and the head 164. When the cam holder 150 is pushed to the right side, the guiding rod 156 will slide through the spring washers 160 and through the bore of the cube head 164, thereby extending more and more through the hole. The spring washers 160 which are held between the cam holder 150 and the ring 162 will be compressed in the course of this motion.

It will be understood that the front cam follower 134 has the same design as the rear cam follower 136 illustrated in FIG. 6.

The cam surface 144 may have a shape such that when the couch is lowered, the two spring systems 138 and 140 will be compressed uniformly. This controls the force of the motor 92 gradually. Therefore, the lifting and the lowering of the couch can be performed uniformly. The illustrated design contributes to a low noise level when the couch is operated. If any of the spring washers 160 should break, that would not mean a disaster. The couch will only sink down slowly. The shaft 156 cannot break during normal operation. Since its free end is gliding in the cube head 164, it is not exposed to strain and stress when the couch is raised or lowered.

In FIG. 7 a single spring washer 160 is illustrated in a perspective view. It can be seen that the spring washer 160 has a concave shape. In FIG. 8 is illustrated the corresponding cross section of the spring washer 160. The hole which receives the guiding rod 156 is denoted as 170.

In FIG. 9, a sectional side view of the upper frame 4 is illustrated. It can be seen that the ring 5 is made up of a smaller inner ring and a greater outer ring. Both rings are connected to each other by juxtaposition of a bearing 190. The outer ring supports a rail system 192 which allows for a longitudinal translation of a table top 194. Rail systems 192 of this nature are well known in the art.

The medical couch illustrated in FIGS. 1 to 9 thus is vertically movable between a lowered position and a raised position, and vice versa. The upper frame of the couch, which carries the patient, is adjustable in various horizontal positions. The couch has a compact structure. An operator (e.g. surgeon, nurse) has free access from all sides to the patient without meeting any difficulties with regard to parts and components sticking out of the scissors assembly. When positioned on a rotatable base, the medical couch can easily be rotated about a vertical axis by 180°.

Due to the illustrated construction principles, there are no operational difficulties in starting the couch from the lower position to a higher position. This is true even for heavy patients. There is no need for having unreasonably big dimensions of the components and parts. It is also very easy to transfer the medical couch from one position to the other. That can be done without any vibrations. One power-operated drive system is sufficient for both double link mechanisms.

Of great importance is the fact that the medical couch does not pose any hazard to a patient if a malfunction of the drive system occurs. In other words, there will be no sudden return from an elevated position into the collapsed position if the drive system should be out of order. Due to the spring system, the security is always maintained.

While the forms of the medical couch herein described constitute preferred embodiments of the invention, it is to be understood that the invention is not limited to these precise forms of assembly, and that a variety of changes may be made without departing from the scope of the invention.

What is claimed:

1. A medical couch, comprising in combination:

(a) a lower frame arranged in a first horizontal plane;

(b) an upper frame for carrying a patient table top, said upper frame being arranged in a second horizontal plane above said first horizontal plane;

(c) a scissors action link mechanism interconnecting said lower frame with said upper frame for moving said upper frame parallel to said lower frame between lowered and raised positions, and vice versa, said link mechanism including a single first and a single second pair of pivotally interconnected support arms, said first pair of support arms being vertically arranged between one side of said lower frame and one side of said upper frame, and said second pair of support arms being vertically arranged between the opposite sides of said lower and upper frames;

(d) an electric motor drive system containing an electric motor and a lead screw, said lead screw being rotatable by said motor and being longitudinally fixed with respect to said drive system, said electric motor drive system comprising a housing having a circular opening in each of two opposite sides thereof;

(e) lower pivoting means for pivotally connecting said electric motor drive system to said lower frame and for pivoting said drive system about a stationary lower horizontal axis, said lower pivoting means comprising two pins arranged horizontally, said pins defining said stationary lower horizontal axis, said pins being firmly connected with said lower frame and extending into a corresponding one of said openings, said lower pivoting means thereby rotating about said pins, said lead screw thereby extending towards said upper frame and pivoting in a plane which is parallel to said pivotal support arms;

(f) a nut element arranged between said first and said second pairs of support arms, said nut element being mounted on said lead screw for travelling therealong;

(g) upper pivoting and supporting means connected to said nut element for pivoting said nut element about an upper horizontal axis and for supporting said link mechanism, said upper horizontal axis being movable parallel to and being arranged elevated above said lower horizontal axis, such that said upper pivoting and supporting means selectively adjusts the elevation of said link mechanism above said lower frame when said motor is in operation and when said nut element travels along said lead screw, thereby moving said upper frame to a selected position; and (h) security means for preventing a sudden return of said upper frame from said raised position to said lowered position.

2. A medical couch, comprising in combination:

(a) a lower frame arranged in a first horizontal plane;

(b) an upper frame for carrying a patient table top, said upper frame being arranged in a second horizontal plane above said first horizontal plane;

(c) a scissors action link mechanism interconnecting said lower frame with said upper frame for moving said upper frame parallel to said lower frame between lowered and raised positions, and vice versa, said link mechanism including a single first and a single second pair of pivotally interconnected support arms, said first pair of support arms being vertically arranged between one side of said lower frame and one side of said upper frame, and said second pair of support arms being vertically arranged between the opposite sides of said lower and upper frames;

(d) an electric motor drive system containing an electric motor and a lead screw, said lead screw being rotatable by said motor and being longitudinally fixed with respect to said drive system, said electric motor drive system comprising a housing having a circular opening in each of two opposite sides thereof;

(e) lower pivoting means for pivotally connecting said electric motor drive system to said lower frame and for pivoting said drive system about a stationary lower horizontal axis, said lower pivoting means comprising two pins arranged horizontally, said pins defining said stationary lower horizontal axis, said pins being firmly connected with said lower frame and extending into a corresponding one of said openings, said lower pivoting means thereby rotating about said pins, said lead screw thereby extending towards said upper frame and pivoting in a plane which is parallel to said pivotal support arms;

(f) a nut element arranged between said first and said second pairs of support arms, said nut element being mounted on said lead screw for travelling therealong;

(g) upper pivoting and supporting means connected to said nut element for pivoting said nut element about an upper horizontal axis and for supporting said link mechanism, said upper horizontal axis being movable parallel to and being arranged elevated above said lower horizontal axis, such that said upper pivoting and supporting means selectively adjusts the elevation of said link mechanism above said lower frame when said motor is in operation and when said nut element travels along said lead screw, thereby moving said upper frame to a selected position; and (h) security means for preventing a sudden return of said upper frame from said raised position to said lowered position.

3. The medical couch according to claim 2, wherein each of said first and said second pairs of support arms is provided with one of said horizontal pivots, and wherein said upper pivoting and supporting means comprises an elongated element having a lateral recess at each of two corresponding sides, each of said pivots being rotatable in a respective one of said recesses.

4. The medical couch according to claim 3, wherein said nut element is threadedly received on said lead screw for moving therealong when said lead screw is rotated by said motor, wherein said elongated element of said upper pivoting and supporting means comprises a cross bar connected to said nut element, said cross bar forming a central recess and having two parallel side pieces, wherein said nut element is attached to said cross bar such that said lead screw extends into said central recess, and wherein said lateral recesses are provided in a respective one of said side pieces.

5. The medical couch according to claim 2, wherein said security means for preventing a sudden return from said raised position to said lowered position contains spring means and wherein said spring means comprise a multitude of spring washers slidably arranged on at least one guiding rod, said spring washers being compressed when said couch is in its lowered position.

6. The medical couch according to claim 5, wherein a cam is provided which is rotatable along with one of said support arms, and wherein the cam surface of said cam operatively engages said spring washers for compressing said spring washers when said support arms rotates such that said upper frame assumes a lowered position.

* * * * *